US007434549B2

(12) United States Patent
Tse

(10) Patent No.: US 7,434,549 B2
(45) Date of Patent: Oct. 14, 2008

(54) OPPOSED DOUBLE PISTON INTERNAL COMBUSTION ENGINE

(76) Inventor: Kwong Wang Tse, Unit 17A, Block 1, 1 WoHong Path., Kwan Tong, Kowloon (HK) 000 000

( * ) Notice: Subject to any disclaimer, the term of this patent is extended or adjusted under 35 U.S.C. 154(b) by 0 days.

(21) Appl. No.: 11/214,155

(22) Filed: Aug. 30, 2005

(65) Prior Publication Data

US 2007/0044738 A1 Mar. 1, 2007

(51) Int. Cl.

| | |
|---|---|
| ***F02B 75/28*** | (2006.01) |
| ***F02B 23/00*** | (2006.01) |
| ***F02B 75/32*** | (2006.01) |
| ***F01B 7/02*** | (2006.01) |
| ***F02F 3/00*** | (2006.01) |
| ***F02F 3/28*** | (2006.01) |
| ***F02F 1/00*** | (2006.01) |

(52) U.S. Cl. ..... 123/51 R; 123/671; 123/193.1; 123/193.5; 123/193.6; 123/197.1; 123/197.2; 123/197.3

(58) Field of Classification Search ..... 123/51 R, 123/51 A, 51 AA, 53.6, 197.1, 47 R, 48 A, 123/78 A, 47 AB, 197.2, 193.1, 193.6, 671, 123/193.5

See application file for complete search history.

(56) References Cited

U.S. PATENT DOCUMENTS

| | | | | | |
|---|---|---|---|---|---|
| 668,058 | A * | 2/1901 | Shaw | 91/178 |
| 687,678 | A * | 11/1901 | Durman | 123/51 R |
| 887,347 | A * | 5/1908 | Schieferstein | 123/51 B |
| 1,075,889 | A * | 10/1913 | Woolf | 123/73 AA |
| 1,624,404 | A * | 4/1927 | Frese | 123/47 R |
| 3,610,214 | A * | 10/1971 | Braun | 123/46 SC |
| 5,083,530 | A * | 1/1992 | Rassey | 123/51 R |
| 5,261,358 | A * | 11/1993 | Rorke | 123/47 R |
| 5,673,665 | A * | 10/1997 | Kim | 123/197.1 |
| 6,314,923 | B1 * | 11/2001 | Tompkins | 123/42 |
| 6,318,309 | B1 * | 11/2001 | Burrahm et al. | 123/51 A |

* cited by examiner

*Primary Examiner*—Stephen K. Cronin
*Assistant Examiner*—Ka Chun Leung

(57) ABSTRACT

An internal combustion engine including at least one engine cylinder includes a cylinder cavity with first and second stopping members interconnected by a cylinder wall, the cylinder further includes two piston members slidably moveable within said cylinder cavity and between extreme positions intermediate between two stopping members, two piston members combust between their faces and cylinder wall pushing them with their power transmittal members alternatively to revolve the cogwheel and axle. By the ratchet function of power transmittal member or cogwheel, each piston has its free returning movement without clinging with the cogwheel and axle, allowing each piston continuously and alternatively revolves the axle without waste of energy for returning movements. An internal combustion engine having the free return movement by this invention has different choices of engine making in one or two pistons, one fuel or two fuels, stopping members or no stopping members for different engine requirements, substantially increases the usable engine power to enhance efficiency and reduces the weight to power ratio.

2 Claims, 9 Drawing Sheets

OPPOSED DOUBLE PISTON INTERNAL COMBUSTION ENGINE

FIELD OF THE INVENTION

This invention relates to internal combustion engines and, more particularly, to internal combustion engines in which a common cylinder and two alike pistons are sharing the common combustion chambers for different combustion motions. More specifically, this invention relates to an internal combustion engine of the four-stroke type with two reciprocating piston members which combust within the common combustion chamber to give power by different piston motions alternatively.

BACKGROUND OF THE INVENTION

This is a new development different from my previous invention U.S. Pat. No. 6,722,322 by the title "Internal Combustion engine", and having an important improvement of making the return movement of the piston after combustion is free from engaging with the mechanism of the axle. This improvement allows an internal combustion engine to run more simple and efficient and also increases flexibility for engine making designs, wherein my previous invention of U.S. Pat. No. 6,722,322 or conventional internal combustion engine is complicated and inefficient in comparison to this invention for their pistons are engaged with mechanism required further combustions for returns.

Internal combustion engines are widely used as power plants for many equipment and apparatuses such as automobiles, power generators, pumps, compressors, ships, tractors, machines, and aeroplanes. In order to supply adequate power, conventional internal combustion engines are generally formed by connecting a plurality of alternately combusting cylinders together. Each cylinder of an internal combustion engine generally includes a hollow combustion chamber inside which there is disposed a linearly and reciprocally moveable piston member.

In general, the piston is driven towards the cylinder head, which is usually the ceiling of a cylinder, to compress the gaseous fuel mixture introduced into the cylinder during one part of the engine cycle. The subsequent timely combustion of the compressed fuel causes an explosion to drive the piston away from the cylinder head. This movement also drives the connecting power transmission mechanism to deliver the resulting mechanical power outside of the cylinder for the intended use.

In general, 1) fuel intake, 2) compression, 3) combustion and 4) exhaustion are the typical steps involved in a complete engine operation cycle steps of a conventional four-stroke internal combustion engine. Because an engine cylinder must withstand the enormous explosive force during the engine operating cycles, internal combustion engines are typically made of steel, wrought iron or other ferrous or non-ferrous metal alloys which are inherently heavy and bulky. Since a plurality of engine cylinders are usually connected together to provide sufficient power output as well as for smooth engine operation, the weight of engines becomes an important factor to negotiate if to improve the efficiency of an engine is to be improved. In general, engine designers endeavour to minimize the engine weight-to-power output ratio, or, alternatively, to maximise the power-to-weight ratio per combustion cylinder. Also, in a multi-cylinder engine, usually only one cylinder delivers power at a time which means that the instantaneous power generating engines must also drive the remaining non-power generating pistons and the connecting mechanism. Therefore, it will be beneficial if the connecting mechanism or parts between cylinders can be minimized for a given set of cylinders.

For example, U.S. Pat. No. 6,318,309 describes an internal combustion engine in which two pistons are reciprocatively disposed in each cylinder thereby forming combustion chamber between the pistons. However, two sets of rather complicated piston connecting rods are required and a third piston is responsible for a specific combustion chamber area not served by the other pistons. U.S. Pat. No. 3,010,440 teaches another example of an internal combustion engine having more than one piston disposed in a single cylinder in which each piston covers its own combustion chamber which is not served by the other piston. These patents and other conventional internal combustion engines have their pistons and engine mechanism engaged mechanically together without any free return movement for the pistons, or, at least not the same as in this invention.

Most conventional internal combustion engine can consume only one fuel, especially fossil fuel, and is dramatically influenced by its market price. It is beneficial to provide an internal combustion engine able to consume two fuels at a time for one regular fuel with other one economical or environmental fuel.

In a conventional four-stroke cycle internal combustion engine, the complete engine operating cycle of fuel intake, compression, combustion and exhaust requires two cycles of linearly reciprocal motion of the piston member. In other words, the piston member has to move up and down twice in order to complete a single engine cycle. Since the engine cycle involving fuel combusting piston is the only power generating part of the cycle, the other piston is non-power generating but power consuming, noting that the piston is usually always connected the an external load. Hence, it will be highly beneficial if combustion of every cylinder is independent to each other for delivery of power without engaging each other mechanically for wasting energy. There are provided in this invention an improved internal combustion engine or engine topology which can overcome or at least mitigate the short-comings associated with the afore-said disadvantages of conventional internal combustion engine.

OBJECT OF THE INVENTION

Hence, it is an object of the present invention to provide an improved internal combustion engine or engine topology which overcome or, at least, mitigate disadvantages associated with conventional internal combustion engines. More specifically, it is an object of the present invention to provide an improved internal combustion engine performance by reducing the engine weight-to-power output ratio. It is also an object of the present invention to provide an internal combustion engine or engine topology in which each piston alternatively only needs to go through a single up and down reciprocal motion in order to complete the fuel intake, compression, explosion and exhaust cycles of an engine operation. It is also an object to provide a returning movement for piston free from axle and related mechanism after such piston has moved away by combustion for power generation. It is also an object to provide an internal combustion engine able to consume two fuels at the same time of engine operation for a chance to select an economical or environmental second fuel. As a minimum, it is at least an object of the present invention to provide the public with a choice of a novel internal combustion engine or engine topology to be described hereinafter.

SUMMARY OF THE INVENTION

In view of the afore-said objectives and according to the present invention, there is provided an internal combustion engine including at least one engine cylinder, said cylinder includes a cylinder cavity with first and second circular stopping members as guards for stopping pistons to run away from cylinder which are interconnected by a cylinder wall without any cylinder head, said cylinder includes two equal diameter piston members allocating combustion face to combustion face and slidably moveable within said cavity and between a first and a second extreme position intermediate between said first and second circular stopping members, said piston members share the common combustion chamber to have their own four-stroke cycle of intake, compression, combustion and exhaustion and power output.

Preferably, one of the said pistons further including outlet for exhaustion, inlets for fuel and sparkplug for ignition, said piston possesses functions of a conventional cylinder head and also a general piston.

Preferably, said engine further including a partition member of a wall with a ditch built on each piston combustion face, said pistons on closing up to each other bring each wall of each piston plunging into the ditch of other piston conforms two separated sections for two different fuels for combustion.

Preferably, each said piston members includes a power transmittal member protruding out of said cylinder, said power transmittal member being connected with the axle by a rotary member in between which converts the translational movements of said power transmittal member into rotary movements of said rotary member and axle with a free returning movement of piston.

Preferably, each said piston member includes a spring member connected between the end of two said power transmittal members or between said power transmittal member and the said cylinder, said spring member stretches from its spring-neutral configuration by the power of the combusting and pushing movement of the piston member, said stretched spring member provides a retracting force to the returning movement of the piston and power transmittal member when the combustion power is exhausted.

Preferably, each power transmittal member as an arm includes teeth on one side engaging with teeth on said rotary member as a cogwheel, said teeth on either said power transmittal arm or said rotary cogwheel is ratchet teeth being arranged so that said teeth on said power transmittal arm are in driving each other engaged mechanically with the teeth on said rotary cogwheel when said power transmittal arm move in a first direction and said teeth on power transmittal arm and said rotary cogwheel are not in driving and clinging engagement and free to each other from moving in a direction opposite and returning to said first direction.

Preferably, said first outward direction of movements of said power transmittal arms in driving engagement with the teeth of said rotary cogwheel but not engaged in their second return direction, and movements of two said power transmittal arms are opposite to each other by combustion of pistons in their common combustion chamber having opposite translational movements alternatively resulting a same direction of rotary movement to the said rotary member and axle by acting on different sides of two rotary cogwheels.

Preferably, each said rotary wheels includes a pair of 45 degree angled gears setting in between said rotary cogwheels and rotary axle whereas the axle is required to place parallel to the direction of motion of said piston and power transmittal members or 90 degree changing of its original perpendicular direction on required.

Preferably, said internal combustion engine brings in a choice of better engine making.

According to a second aspect of the resent invention, there is provided an internal combustion engine includes at least an engine cylinder, said engine cylinder includes a hollow cylinder room enclosed by a cylinder wall and a first and a second stopping guards at the ends of said cylinder room, said engine cylinder further includes two pistons sharing a common combustion chamber, each said pistons includes a power transmittal arm protruding out of the said cylinder connecting a rotary cogwheel for delivery of power, said pistons also include a wall and a ditch for the choice of engine making if two fuels are required to consume at the same time, one of said pistons includes inlet and outlet for fuel and exhaustion as a convention cylinder head, said power transmittal arm includes a spring connecting between power transmittal arms or between arm and cylinder for power of returning movement, such that, during engine operation, a complete cycle of reciprocating movements of each said pistons corresponds to each other working their own output power in the same combustion chamber.

BRIEF DESCRIPTION OF THE DRAWINGS

Preferred embodiments of the present invention of an internal combustion engine or engine topology will be explained in more detail in the specific description below by way of examples and with reference to the accompanying drawings in which.

DETAILED DESCRIPTION OF THE PREFERRED

EMBODIMENTS

Figure 1A:
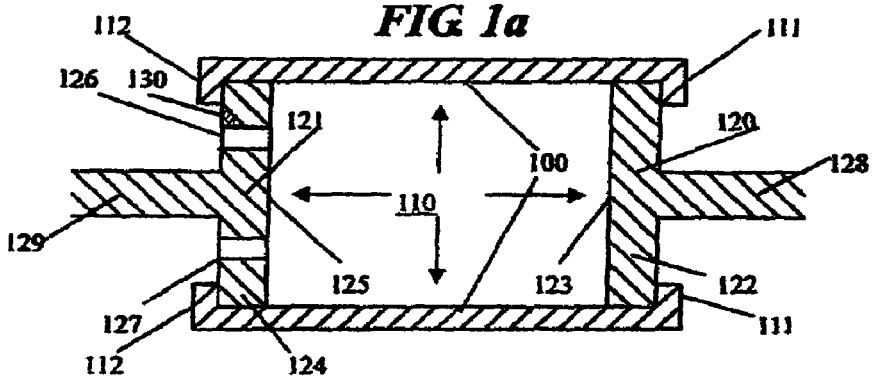
FIGS. 1*a* to 1*d* show schematic half-sectional diagrams for cylinder and piston of an internal combustion engine illustrating a first preferred embodiment on the principle of engine operation of the present invention.

Referring firstly to FIGS. 1*a* to 1*d*, there are shown schematic simplified half sectional sketches for a first preferred embodiment on the principle of engine operation undergoing in cylinder of an internal combustion engine by present invention. The figures show a series of engine operating movements to illustrate the general working principles. The engine generally includes at least one engine cylinder, although a plurality of engine cylinders may be, and are generally, connected together to meet with specific power and operation requirements and to fulfil various performance criteria.

The cylinder (100) generally includes a hollow cylinder housing (110) having a first circular stopping guard (111) on one cylinder end and a second circular stopping guard (112) on other cylinder end. These two circular stopping guards (111, 112) are interconnected by a cylinder wall. The cylinder (100), including the cylinder housing (110), two piston members (120, 121) is preferably made of steel, wrought iron or other rigid metal, both ferrous and non-ferrous, alloys suitable for engine making. The space or cavity defined between the stopping guards and the surrounding cylinder wall forms a common combustion chamber for power generation to be explained in more detail below. The piston (120) includes a piston head (122) with a combustion face (123) is slidably moveable along the length of the hollow cylinder. The piston (121) includes a piston head (124), a combustion face (125), an inlet (126) for fuel with a sparkplug installed in a hole (130) specifically provided and an outlet (127) for exhaustion is also slidably moveable along the same combustion chamber for power generation. Two piston heads (122, 124) are disposed within the cylinder with their combustion faces (123, 125) face to face.

Inlet (126) outlet (127) are connected with of fuel supply and exhaustion muffler respectively with their open/close installations.

In general, two piston heads (122, 124) are moveable from an extreme position of a stopping guard to the face of other piston in co-operative to have their own combustion for power within a common combustion chamber. Two piston members (120, 121) are connected to their power transmittal member (128, 129) as an arm protruding outside the cylinder so that the power generated from movements of the piston members resulting from the combustions of fuel in the combustion chamber can be transmitted out of the cylinder (100). On the other hand, two piston members (120, 121) are driven to compress the combustible gaseous fuel mixture in a combustion chamber in advance of and to prepare for combustion.

Referring to FIG. 1*a*, the cylinder (100) is shown a combustion upon ignited by sparkplug (130) to the gaseous fuel mixture causes explosion within the combustion chamber and drives two piston heads (122, 124) up to their own stopping guards (111, 112) respectively. At the same time of the moving piston reached its extreme position, the exhaustion outlet (127) is open for exhaustion of combustion emission. Sparkplug installed in hole (130) specifically provided is always as in FIG. 1*a* on every figure even it is not shown.

Figure 1B:
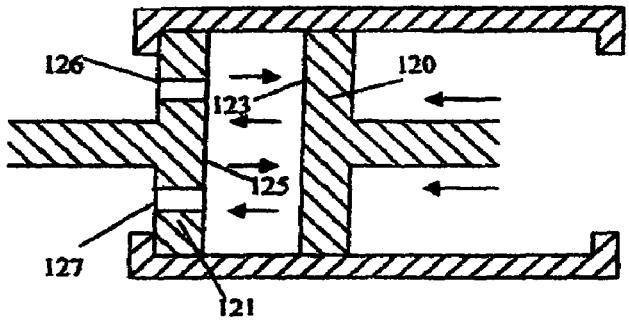

Referring to FIG. 1*b*, after closed of the exhaustion outlet (127) as exhaustion finished, fuel inlet (126) is open for gaseous fuel mixture to fill up the combustion chamber and is closed right after the filling of fuel is finished. The compression of fuel between two faces (123, 125) is started by moving of the piston member (120) towards other piston (121) up to a required compression position as in FIG. 1*b* ready for combustion.

Figure 1C:
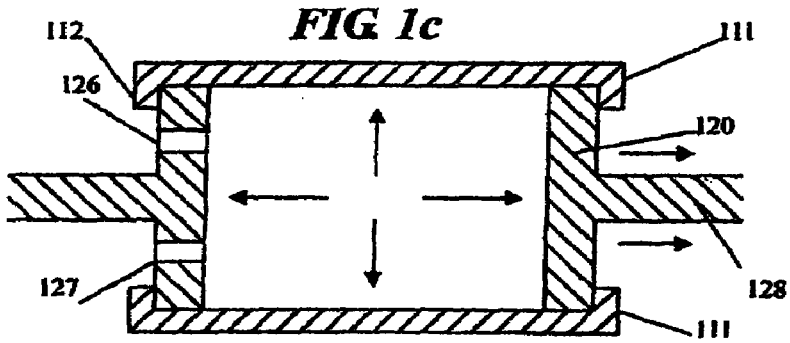

Referring to FIG. 1*c*, upon ignition of sparkplug on inlet (126), the compressed gaseous fuel combusts and drives the piston member (120) up to its extreme position against stopping guard (111). The combustion power in the combustion chamber is transmitted outside of cylinder by the moving of the power transmittal arm (128), and exhaustion outlet (127) is open for exhaustion after the piston (120) has finished its power transmission job by the movement.

Figure 1D:
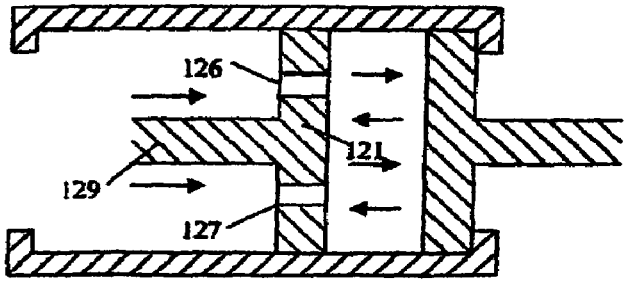

Referring to FIG. 1*d*, right after the exhaustion is finished, exhaustion outlet (127) is closed and fuel inlet (126) is open for another fill up of gaseous fuel mixture. Fuel inlet (126) is closed again as refill is finished. Piston member (121) starts to move to the required position as in FIG. 1*d* to compress the fuel into a state of ready for combustion by the moving of piston (121). After the combustion is ignited by the sparkplug on inlet (126), piston member (121) is driven to its extreme position up to stopping guard (112) as in FIG. 1*a*. Another cycle of combustion starts and engine operation carries on. Same numerals of FIG. 1*a-d* are used to same parts for FIG. 2 to FIG. 6, whereas new numerals are used for FIG. 7 for avoiding confusion because it is an amalgamated embodiment from different examples.

In general referring to FIG. 1*a-d*, each piston (120, 121) member has its own fuel intake, fuel compression, combustion and exhaustion in one single up and down movement. This invention brings two pistons work together cooperatively in one cylinder. There are some other choices for different design for engine making according different efforts and requirements. Despite two pistons design, this invention can run only one piston as in FIG. 7, whereas the other piston has been replaced by a conventional cylinder head. This choice of one piston instead of two is making the engine having less power but more simple than in FIG. 1. Another choice for engine design is selectable on control from one or two pistons operating for the same engine. If only one piston is required, other piston is in a station position right at the extreme position against its stopping guard for saving of energy without moving until two pistons are required again. Another advantage of this invention having two pistons in one engine cylinder is engine still able to run even one piston is broken down accidentally.

Figure 2:
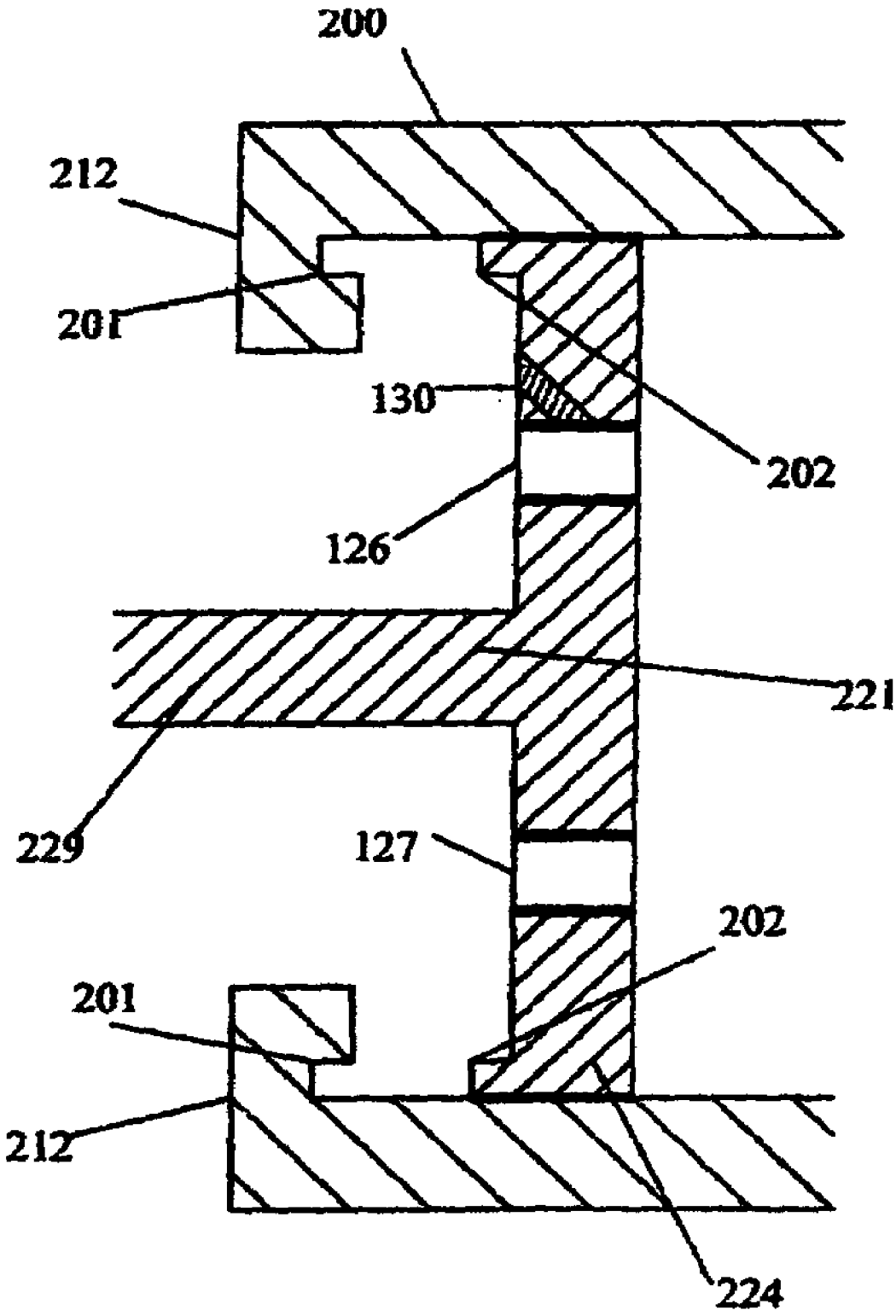
FIG. 2 illustrates an enlarged construction of engine of FIG. 1 for design to avoid direct impacts of piston and stopping guard.

FIG. 2 illustrates an example of engine construction by an enlarged simplified sectional view of cylinder (200) and piston (221) as in FIG. 1*a-d*. In order to avoid continuous impacts of piston head (224) and circular cylinder stopping guard (212), a circular shallow ditch (201) is made inside the stopping guard and at the base of the piston facing the stopping guard a circular jutting rim (202) is built to be running into the ditch perfectly in engine operation. Referring to FIG. 2 at the time of engine operation, piston head (224) is going to impact the stopping guard (212), for every movement circular jutting rim (202) is running into the circular shallow ditch (201) and trapping some air within the ditch. Such air is forming an air cushion in between ditch and rim preventing their direct impacts and avoiding damages.

Figure 3A:
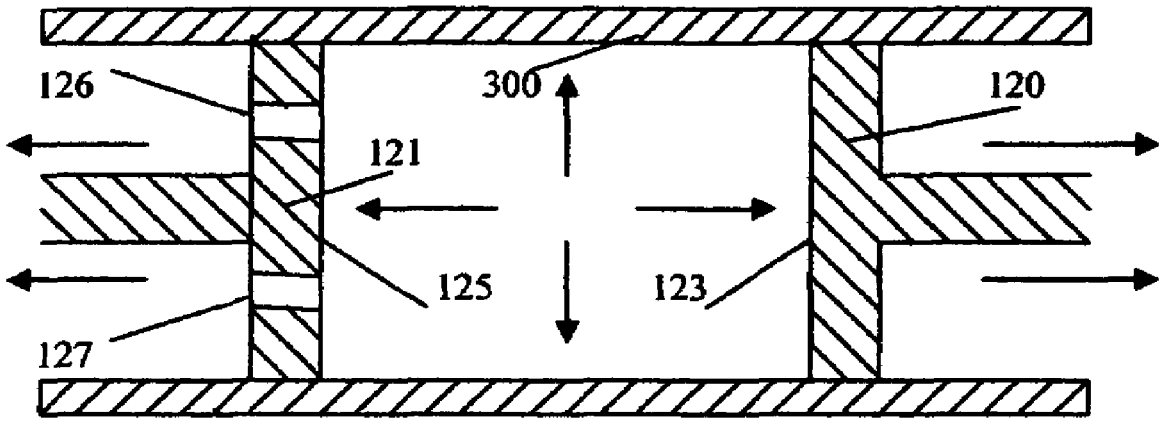
FIG. 3*a* to 3*b* show schematic diagrams of a second embodiment of engine operation of this invention from cylinder to piston.
Figure 3B:
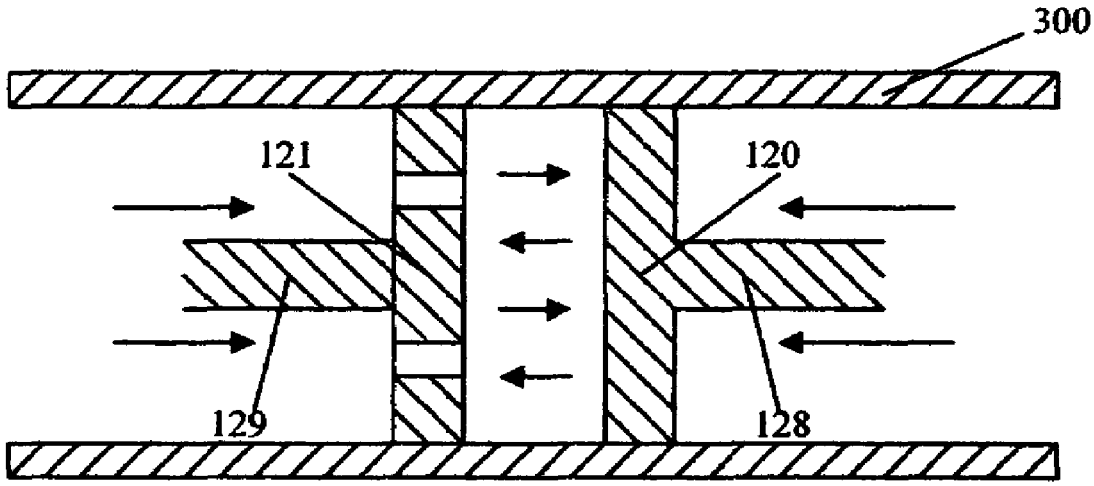

Referring to FIG. 3*a-b*, it is another example to avoid damages from direct impacts to the pistons and cylinder and also a second embodiment of engine operation. Cylinder (300) has been constructed without any stopping guards and cylinder head to have engine operation different from FIG. 1*a-b*. An engine combustion of gaseous fuel is taking place in FIG. 3*a*, and forcing two pistons (120, 121) going away by the power of combustion at the same manner. When two pistons move away and reach a required position for transmission of power, exhaustion outlet (127) is open for exhaustion of emission bringing the pistons loss the power of combustion in FIG. 3*a*. Outlet (127) is closed immediately after exhaustion finished, and fuel inlet (126) is open for fuel refilling. After refill is completed inlet (126) is closed, compression of fuel starts by two pistons (120, 121) going towards each other at the same time as FIG. 3*b*. When two pistons compress the fuel in between their combustion faces (123, 125), and reach their required positions for compression, fuel is compressed and ready for another combustion. Combustion is ignited by sparkplug, two pistons (120, 121) are expelled to run away from each other until they reach their required positions again with outlet (127) open for exhaustion as in FIG. 3*a* again and engine is going on its operation. This design for invention is a choice for design if stopping guards are not wanted. Engine operation of this design makes two pistons work at the same manner being pushing away by the combustion with two power transmittal arms (128, 129) for delivery of their powers without any impact to the pistons and cylinder too.

Figure 4A:
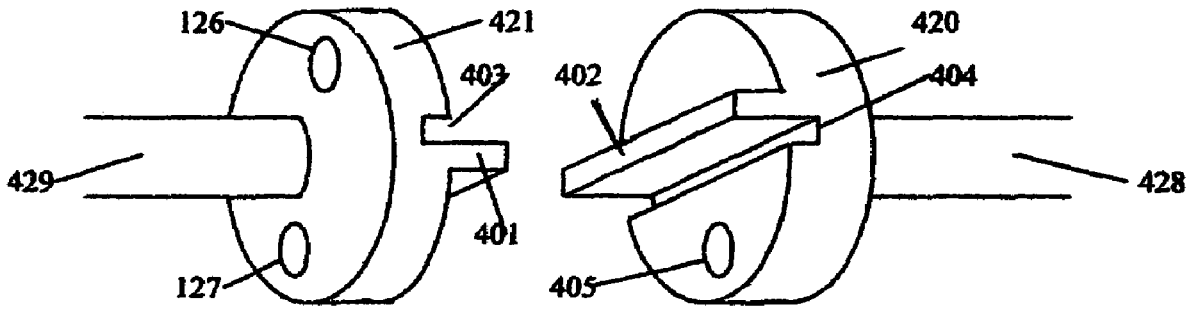
FIG. 4*a-c* illustrates a third embodiment of engine operation of this invention by a pair of different pistons with wall and ditch on a different function if two fuel are required to consume at the same time.
Figure 4B:
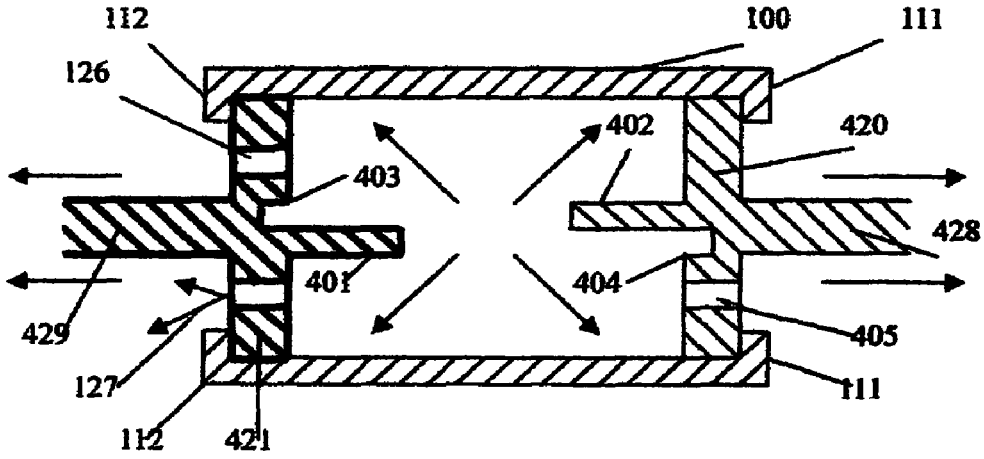
Figure 4C:
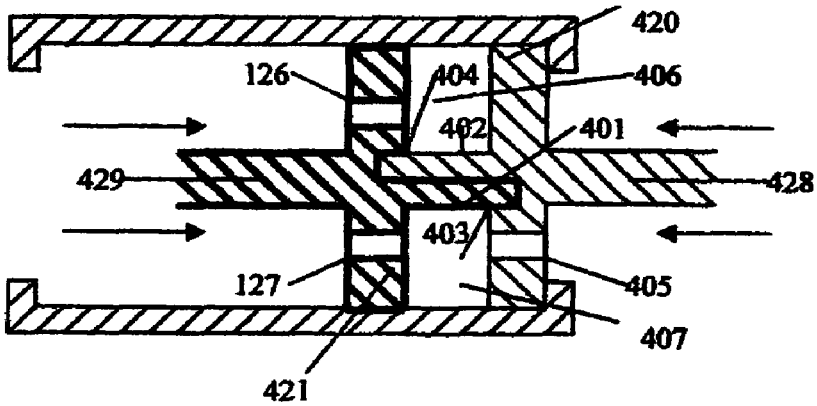

Referring to FIG. 4*a-c*, it is an example of this invention for a choice of design for engine making of pistons to consume two fuels at same time in same cylinder. FIG. 4*a* is an overall view of two pistons (420, 421). A straight jutting wall (401) and a straight shallow ditch (403) are built on piston (420) with fuel inlet (126) and exhaustion outlet (127). Another straight jutting wall (402) and straight shallow ditch (404) are built on piston (421) in opposite position with a new fuel inlet (405). From FIG. 4*b*, a combustion is ignited and two pistons (420, 421) are expelled to their extreme positions against their own stopping guards (111, 112) respectively. Immediately after exhaustion finished, outlet (127) is closed and power transmittal arm (129) starts to move piston (421) towards piston (420). In FIG. 4*c*, piston (421) is moved to a position wall (401) is plunging into ditch (404) and wall (402) is plunging into ditch (403) forming two separated combustion chambers (406, 407). Inlet (126) is open for filling of first gaseous fuel mixture, a regular fuel mixture, into combustion chamber (406) and inlet (405) is open for second gaseous fuel mixture into combustion chamber (407). Because these two fuels are pre-pressurized gaseous fuel, they are directly filled up at required pressure with no compression process is required. After fillings of fuels are finished as inlets are closed, sparkplug on inlet (126) ignites combustion of fuel in combustion chamber (406) as it is a regular fuel. Combustion produces great pressure and heat in combustion chamber (406) expels two pistons (420, 421) going away from each other bringing two walls (401, 402) away from their ditches (404, 403) respectively. As two walls and ditches break apart, explosion of fuel in combustion chamber (406) is going over to other combustion chamber (407) and combusts the second fuel by great pressure and heat causes a greater combustion of two fuels pushing piston (421) going away to its original position against its stopping guard (112). Other processes of combustion refer to FIG. 1*a-d*. This is a good method to consume a more economic fuel as: plantation fuel, emission, hydrocarbon, steam, water vapor by the extreme hot combustion of hydrogen.

Figure 5:
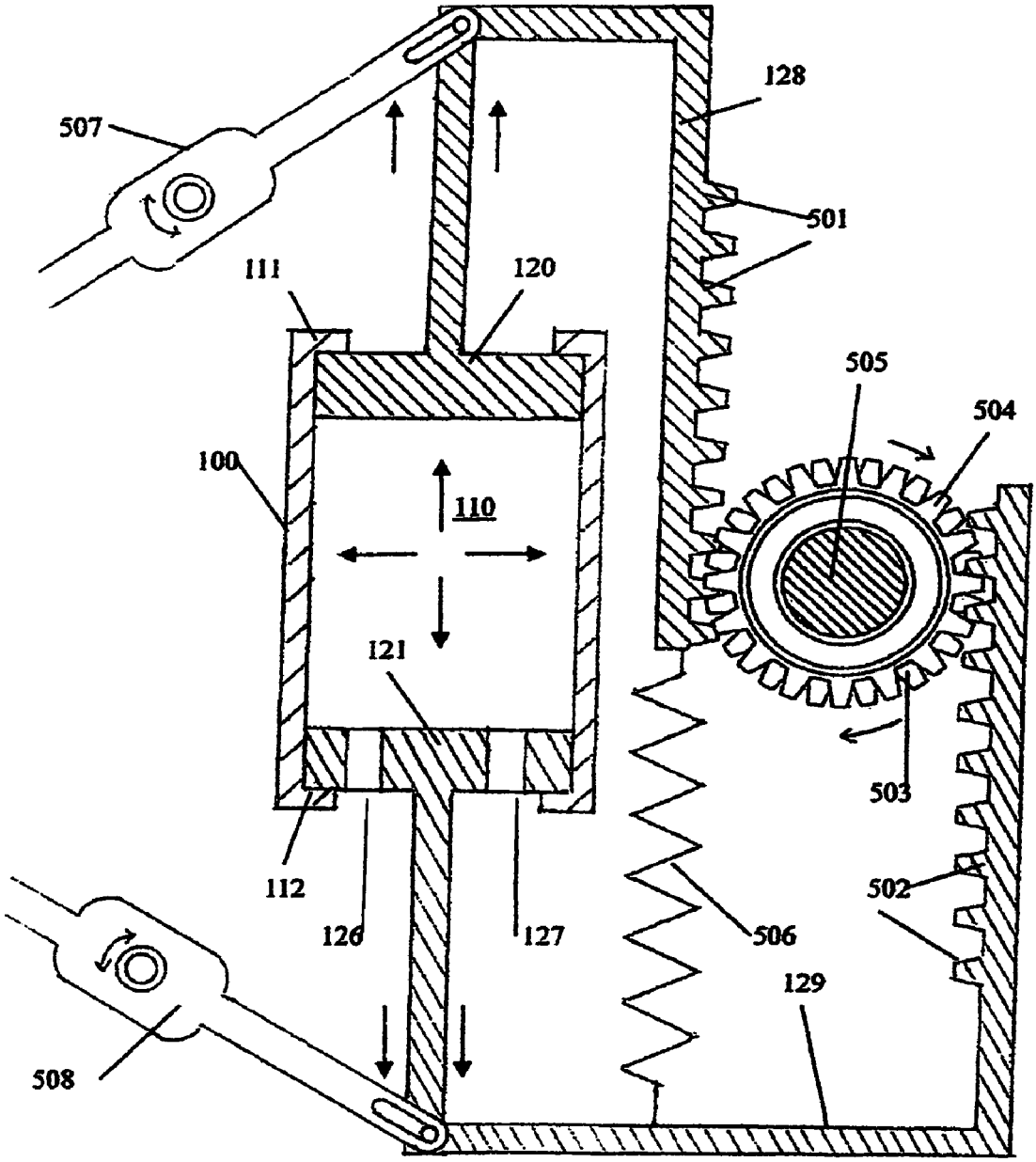
FIG. 5 shows an overall structure diagram of a first example of engine operating from cylinder to axle whereas cylinder and axle are lying perpendicular to each other.

Referring to FIG. 5, a diagram of sectional view for details of the first embodiment of this invention from the cylinder to the axle shows how the power of combustion is transmitted outside from the cylinder to the axle having a free return movement for pistons. Cylinder (100) just has combustion in cavity (110) causing either piston members (120, 121) expelled to their extreme positions against their stopping guards (111, 112) respectively following the process of engine operation as FIG. 1*a-d*. Two power transmittal arms (128, 129) protruding from the back of the pistons are made in U forms with series of teeth (501, 502) at their ends respectively. These teeth are engaging with the teeth of two revolving cogwheels (503, 504) which are holding main axle (505) for revolving. Either the teeth (501, 502) of the power transmittal arms (128, 129) or the teeth of the cogwheels (503, 504) are made ratchet. For example, two revolving cogwheels are ratchet and are engaging with the solid teeth of the arms. In FIG. 5 every combustion of the cylinder (100), pushing either pistons (120, 121) alternatively on their engaging respective cogwheels (503, 504) revolve with axle (505). These two ratchet cogwheels are mounted on the axle in same ratchet direction for having a same revolving clockwise direction in FIG. 5 for two power transmittal arms are engaging on opposite sides of two ratchet cogwheels. Spring member (506) is connected between two power transmittal arms (128, 129) and is stretched and stored with combustion power. When combustion is finished by exhaustion through outlet (127) and right after combustible fuel refilled through inlet (126), lose of combustion power in combustion cylinder brings the stored retraction power of the stretched spring (506) forces either required power transmittal arm (128, 129) come back to its required position closing to other piston by the timely control system of their leverage pivot (507, 508) respectively for compression of fuel. At return movements of either power transmittal arms (128, 129) their teeth engaged to the teeth of cogwheels are free on return movement as this is the main characteristic of ratchet function. By the control of the pivots (507, 508) and following the process of engine operation from FIG. 1*a* to FIG. 1*b*, piston (121) is stationed on its position against its stopping guard (112), so piston (120) has a free return movement closing to piston (121). This return movement also brings a compression to the gaseous fuel mixture in cavity (110) by the retraction force of the spring (506). In addition, as both pistons are connected to their pivot systems for controlling of process, additional forces can be applied from momentum of flywheel or combustion of other cylinder of engine through the pivot if additional forces are required. After gaseous fuel mixture is compressed as in FIG. 1*b*, combustion ignited by sparkplug on the inlet (126) causes piston (120) pushed back to its original position against its stopping guard (111) as in FIG. 5 again and also in FIG. 1*c*. On the way pushing piston (120), teeth (501) of power transmittal arm (128) pushes teeth of ratchet cogwheel (503), cogwheel (503) and axle (505) to revolve clockwise again as they are solid engaged on this direction. It is the same happening to piston (121) as it is free in engaging with cogwheel (504) for closing to piston (120) for compression of fuel after exhaustion as FIG. 1*d*. Combustion coming after FIG. 1*d* pushes the piston (121) back to against its stopping guard (112) bringing the ratchet cogwheel (504) and axle (505) revolve on clockwise direction again. Continuation of combustion causes the main axle (505) revolving again and again by the alternative revolving of two ratchet cogwheels (503, 504) by the pushing of two power transmittal arms (128, 129) alternatively because of solid engaging. Their free return movements bring two piston members (120, 121) back to their original position without clinging with the axle mechanism by free return movements of ratchet cogwheels (503, 504). Two cogwheels (503, 504) are mounted on the axle (505) with same ratchet directions for two pistons (120, 121) are combusting in opposite directions but teethed to revolve on opposite sides of cogwheels.

Figure 6A:
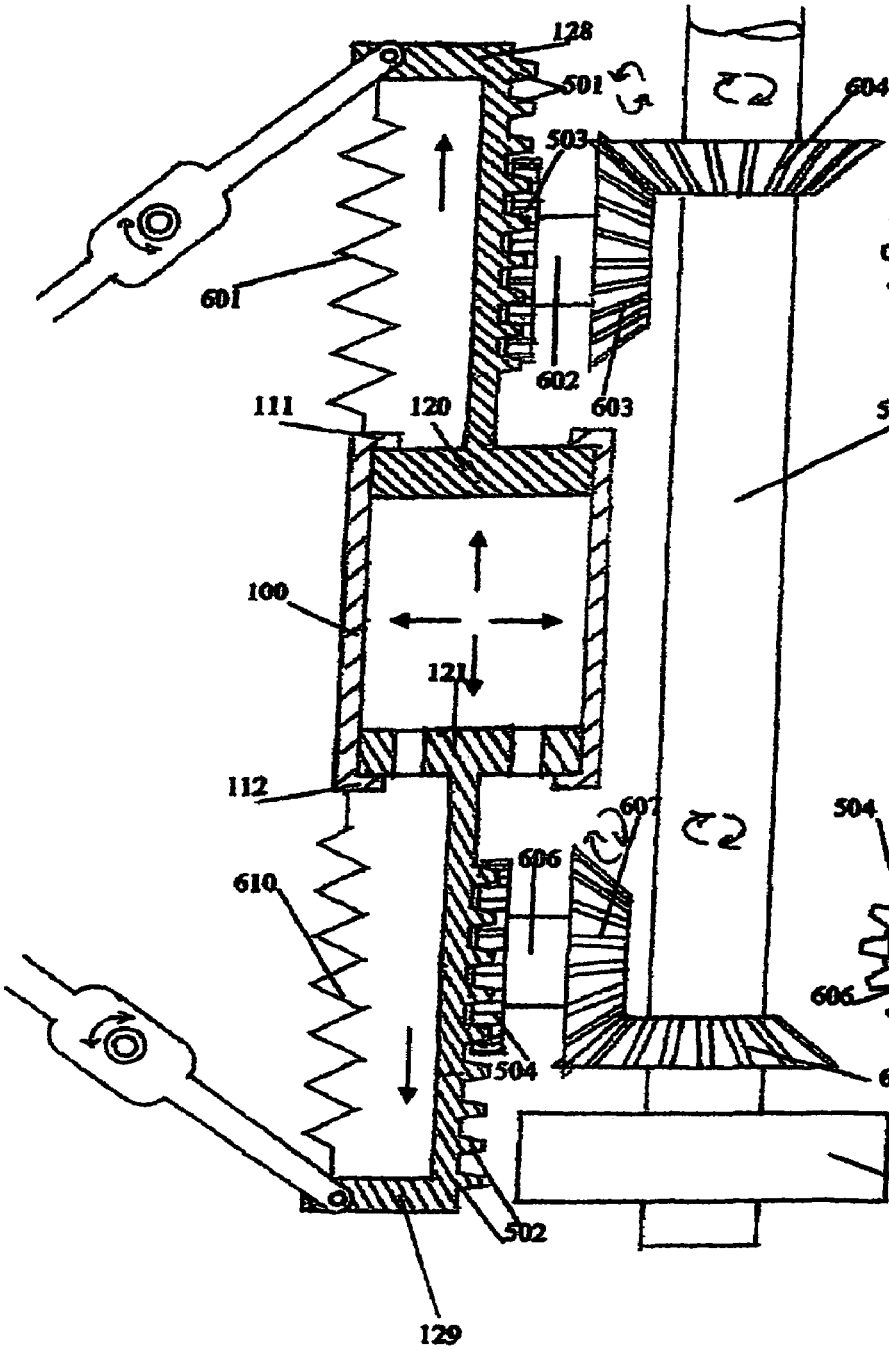
FIG. 6*a* shows an overall structure diagram of a second example of engine operating from cylinder to axle whereas cylinder and axle are lying parallel to each other.
Figure 6B:
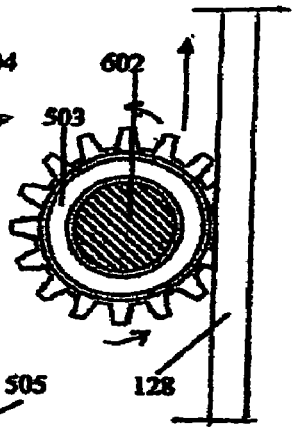
FIGS. 6*b* and 6*c* show the moving direction of two power transmittal arms and the rotating directions of two rotary cogwheels from their side views.
Figure 6C:
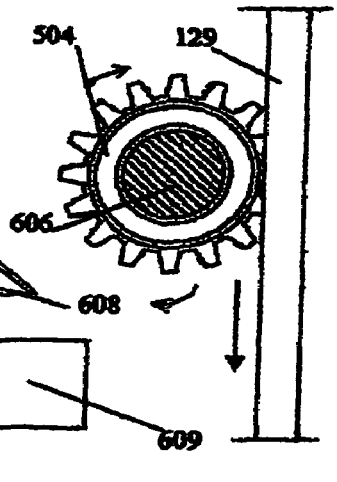

Referring to FIG. 6*a-c* illustrates a second embodiment of this invention for a different arrangement of engine construction from cylinder to axle. FIG. 5 is an embodiment for the cylinder lying perpendicular to the axle as most conventional engines, whereas FIG. 6*a* is an embodiment for lying parallel to each other. In FIG. 6*a*, combustion in cylinder (100) causes piston (120) expelled from position closing to piston (121) to its extreme position against its stopping guard (111) as engine operation in FIG. 1*b-c*. Moving of teeth (501) of power transmittal arm (128) of piston (120) by the combustion power brings teeth of ratchet cogwheel (503), cogwheel (503) and axle (602) revolve as they are solid engaged together by ratchet function and also spring (601) stretched. Ratchet cogwheel (503) is attached to an axle (602) with a 45 degree angled gear (603) at other end engaged to another 45 degree angled gear (604) holding with the main axle (505). FIG. 6*b* is side view for the moving of power transmittal arm (128) brings an anti-clockwise direction to cogwheel (503) and also the first 45 degree angled gear (603) in FIG. 6*a*. Their anti-clockwise directions at the same time bring second 45 degree angled gear (604) and also main axle (505) revolving clockwise and is total 90 degree change of direction from the cogwheel to the main axle. Teeth (502) of power transmittal arm (129) is engaged with other ratchet cogwheel (504) attached to axle (606) with a 45 degree angled gear (607) at other end engaging with another 45 degree angled gear (608) holding with the main axle (505). FIG. 6*c* shows the moving of the power transmittal arm (129) causes a clockwise direction to the ratchet cogwheel (504) and also first 45 degree angled gear (607) in FIG. 6*a*. Their clockwise directions at the same time bring the second 45 degree angled gear (608) and the main axle (505) in anti-clockwise direction as power transmittal arm (129), cogwheel (504) and axle (606) are solid engaged in this direction by ratchet function. Combustion in cylinder (100) brings either pistons (120, 121) going away for power generation directing main axle (505) revolves by their ratchet function and springs (601, 610) stretched. As combustion is finished, either piston (120, 121) goes back to their required position closing to other pistons by the retraction force of the spring (601, 610) with a free returning movement by the free ratchet function of ratchet cogwheel (503, 504) get ready for next combustion. Since both second 45 degree angled gears (604, 608) are holding the main axle (505) in the opposite manner, this arrangement brings the main axle (505) revolve in the same direction by every combustion in the cylinder (100) whereas the cylinder and main axle are lying parallel to each other caused by two pistons (120, 121) moving in opposite directions. The return movements of the pistons (120, 121) have free ratchet movements either from the ratchet cogwheel (503, 504) or ratchet teeth (501, 502) of their power transmittal arms (128, 129). Forces for return movement of pistons (120, 121) and compression of fuel are come from either retraction of springs (601, 610), momentum of flywheel (609), combustion of other cylinder if available, or their combination of forces.

Figure 7:
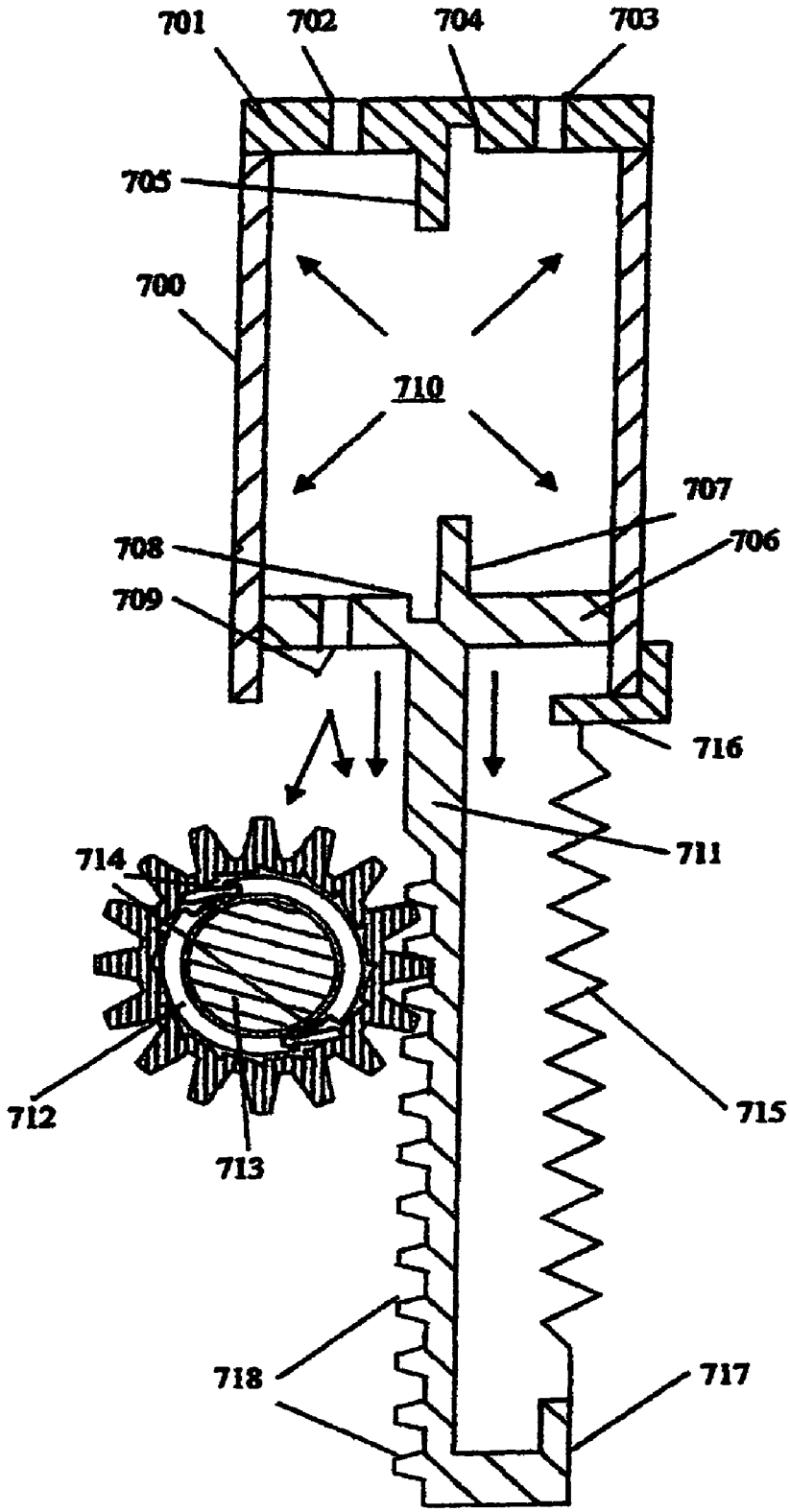
FIG. 7 shows a third example with a flexible and simple structure operating by a conventional cylinder head with one piston, one power transmittal arm, one rotary cogwheel and axle system of this invention.

Referring to FIG. 7 illustrates another embodiment of this invention with its flexible structure amalgamated from parts of different above figures so new numerals are used for avoiding confusion. Cylinder (700) with cavity (710) includes a conventional cylinder head (701) with two fuel inlets (702, 703) building on either side of a straight wall (705) and a ditch (704) as FIG. 4. There are another straight wall (707), another ditch (708) and an exhaustion outlet (709) built on piston (706). One power transmittal arm (711) built on the base of piston (706) with its teeth (718) is engaging to the teeth of ratchet cogwheel (712). Two ratchet pins (714) inside ratchet cogwheel (712) allow teeth (718) of power transmittal arm (711) pushes the cogwheel to revolve by its forward movement of the arm for solid engaging to cogwheel (712) and axle (713) at this direction because of solid engaging between pins and internal gear of ratchet cogwheel (712). On the opposite return movement, internal gear of cogwheel will slip over the surface of the pins without engaging. Spring (715) is built between supporter (716) on the wall of the cylinder and another supporter (717) on the end of the power transmittal arm (711). Before combustion of fuel is happened, two pre-pressurized combustible fuels are injected into two fuel chambers from two fuel inlets (702) and (703) on the cylinder head (701) similar to FIG. 4*c* as two fuels are filled into Chambers (406, 407) by inlets (216, 405). The regular fuel is combusted by the sparkplug on fuel inlet (702) and forcing the piston (706) going away and breaking the partition of the walls (705, 707) with ditches (704, 708). Combustion with high heat and pressure in regular fuel chamber goes over to other economical fuel chamber and combusts other fuel causing a bigger joint combustion in FIG. 7 as FIG. 4*b*. Piston (706) with power transmittal arm (711) pushed to the far side from the cylinder head (701) by the power of the combustion brings an outward movement to the piston (706) and arm (711) directing the cogwheel and the axle revolve by the solid engaging between the teeth (718) of arm (711) and cogwheel (712) by the ratchet function of the cogwheel (712). The outward movement of the power transmittal arm (711) not only revolves the axle but also stretches the spring (715) and stored the power for backward movement of piston (706). Stronger spring can supply stronger backward force if compression of fuel is required to do at the same time but not for pre-pressurized fuel in this figure. In FIG. 7 piston (706) has reached and stopped at a require position by opening of exhaustion outlet (709) for emission whereas no stopping guard is required for piston (706) is stopped by exhaustion of combustion. Stretched spring (715) retracts by the stored force and brings the power transmittal arm (711) and piston (706) back to original position again as FIG. 4*c* by their free return movement of the ratchet function this time and forms two fuel chambers again by the closing up of two walls (705, 707) and two ditches (704, 708). Two pre-pressurized fuels refill their different fuel chambers for another combustion brings the internal combustion engine going on the operation by a simple engine construction. There is another choice for simpler engine making of one wall and one ditch system instead of two if enough strength to resist combustion power against the wall has been considered.

Embodiments on FIGS. 5, 6 and 7 are showing operation of different engine designs of this invention allowing internal combustion engine become more efficiency for less clumsy parts and more flexible for different engine requirement.

Figure 8A:
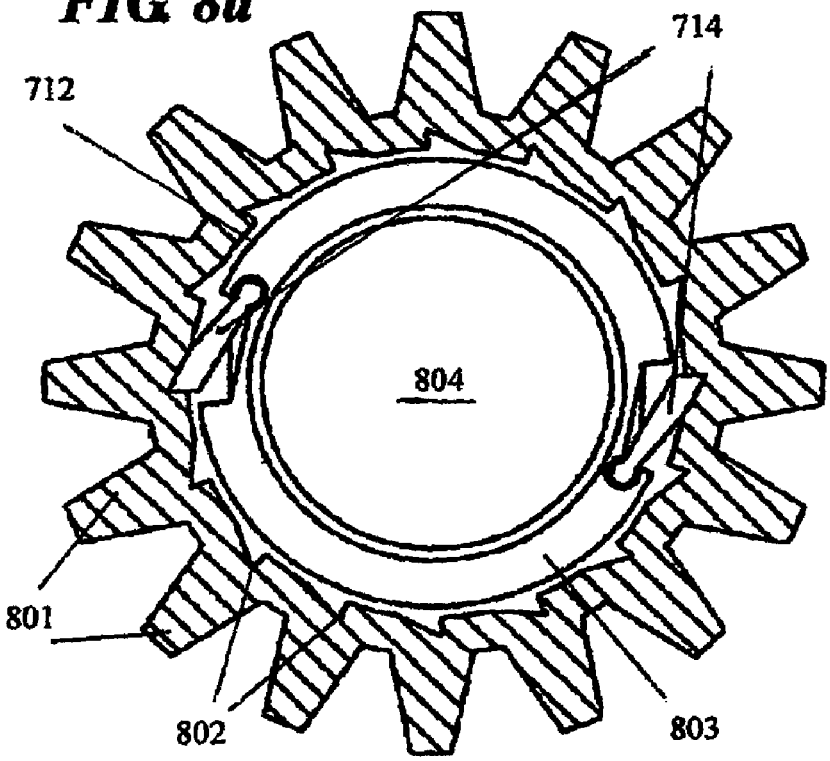
FIG. 8*a-b* illustrates sectional views of an enlarged example of a ratchet cogwheel with its ratchet pins working out its ratchet function reproduced from my previous U.S. Pat. No. 6,722,322 B2-FIG. 14a-b for reference.
Figure 8B:
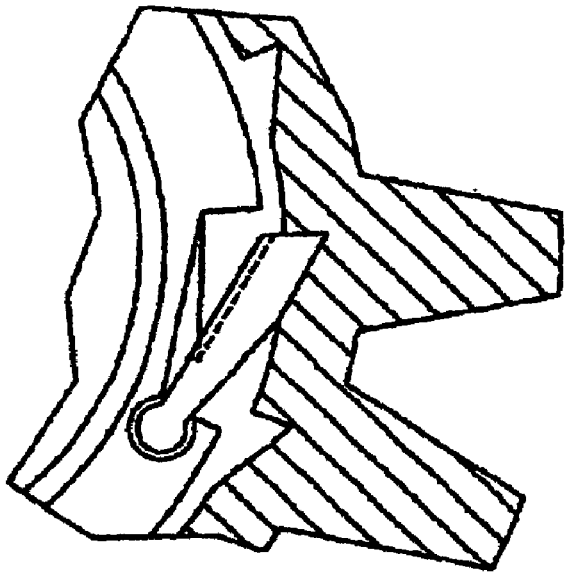

FIG. 8*a* illustrates an example of ratchet cogwheel enlarged in details reproduced from my previous invention of an internal combustion engine FIG. 14a-b of U.S. Pat. No. 6,722,322 B2 including two ratchet pins (714) of the cogwheel (712) as explaining in FIG. 7 whereas teeth (801) and internal gear (802) in a piece is revolving around base (803) and pins (714) of another piece. Center room (804) is room for main axle to go through. In FIG. 8*b*, it shows the pin is solid engaging with internal gears working the ratchet function when the teeth are moving in clockwise direction, but the teeth and internal gear are slipping over the pin with no engaging for moving in anti-clockwise direction.

Figure 9:
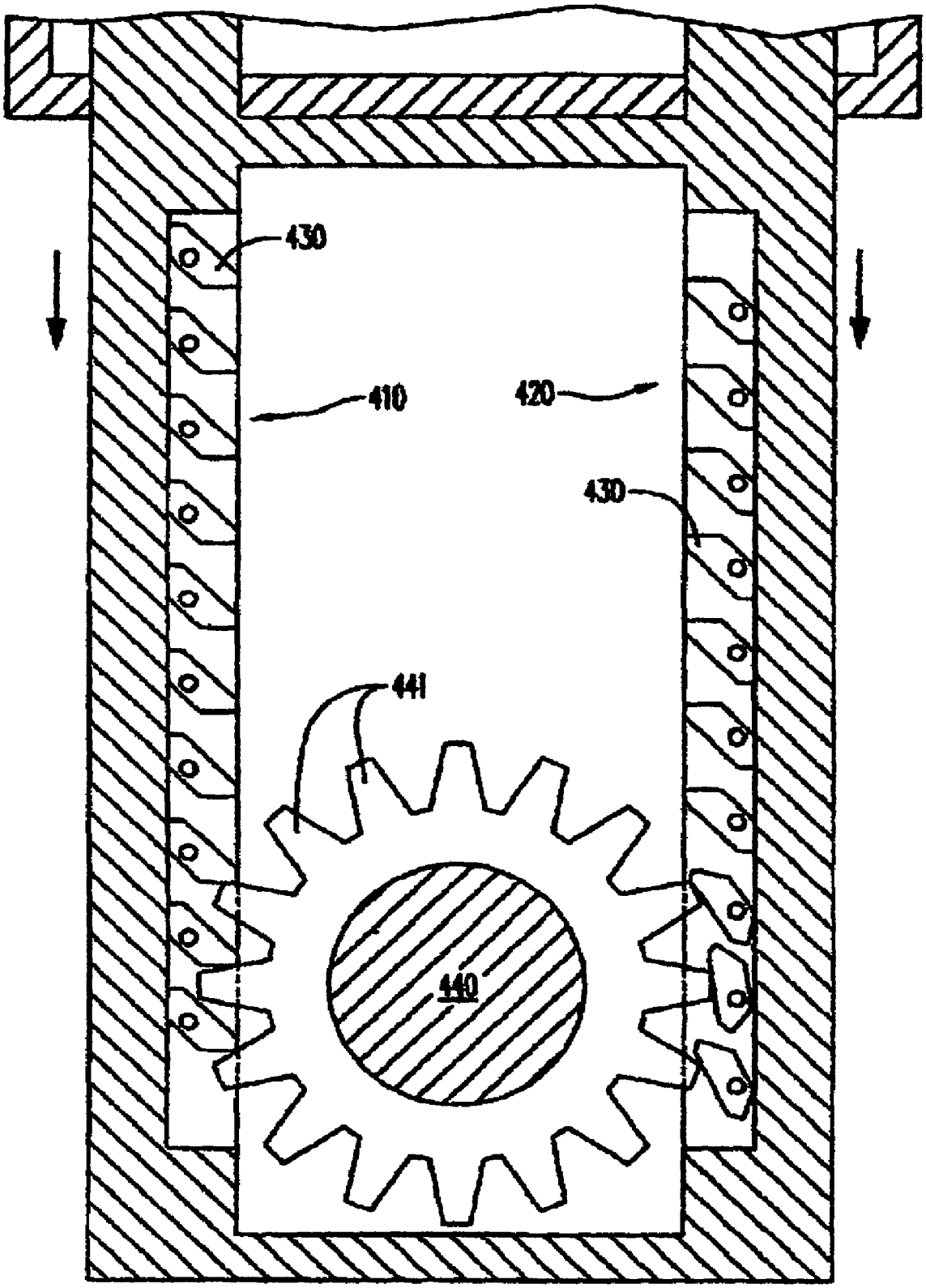
FIG. 9 illustrates an example of a ratchet power transmittal arm with its ratchet gears reproduced from my previous U.S. Pat. No. 6,722,322 B2-FIG. 10a for a choice of ratchet function for reference.

FIG. 9 illustrates an example of ratchet power transmittal arm in details reproduced from my previous invention of an internal combustion engine FIG. 10*a* with its original numerals of U.S. Pat. No. 6,722,322 B2 whereas only one rack of ratchet teeth is required for each power transmittal arm in this invention. Ratchet function of the power transmittal arm is working out by the solid engaging or slipping over of moveable teeth (430) of power transmittal arm to the rotating teeth (441) of cogwheel on different direction of moving. It is for a choice of ratchet function in this invention if ratchet cogwheel is not considered.

What I am claiming is:

1. An internal combustion engine comprising: two opposed pistons positioned face to face from one another, wherein each of the two opposed pistons includes a jutting straight wall and a straight shallow ditch built on their opposed combustion faces, and wherein during a compression stroke the straight walls and ditches of the two opposed pistons meet to form two non-communicable combustion chamber halves, and further wherein each of the two non-communicable combustion chamber halves includes their own separate and different fuel supplying systems for providing two different fuels when the two halves are closed tightly such that they are combusted together automatically in a single cylinder during engine operation.

2. An internal combustion engine comprising: a cylinder head and a reciprocating piston, wherein the cylinder head and the reciprocating piston each have combustion faces which includes a jutting straight wall and a straight shallow ditch, and wherein during a compression stroke the straight walls and ditches of the combustion faces meet to form two non-communicable combustion chamber halves, and further wherein each of the two non-communicable combustion chamber halves includes their own separate and different fuel supplying systems for providing two different fuels when the two halves are closed tightly such that they are combusted together automatically in a single cylinder during engine operation.

* * * * *